US007690215B2

(12) United States Patent
Bender et al.

(10) Patent No.: US 7,690,215 B2
(45) Date of Patent: Apr. 6, 2010

(54) DEVICE FOR COOLING METAL SHEETS AND STRIPS

(75) Inventors: Hans-Jürgen Bender, Olpe (DE); Markus Cramer, Attendorn (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 606 days.

(21) Appl. No.: 10/594,955

(22) PCT Filed: Feb. 9, 2005

(86) PCT No.: PCT/EP2005/001296

§ 371 (c)(1),
(2), (4) Date: Sep. 29, 2006

(87) PCT Pub. No.: WO2005/105334

PCT Pub. Date: Nov. 10, 2005

(65) Prior Publication Data

US 2008/0264073 A1 Oct. 30, 2008

(30) Foreign Application Priority Data

Mar. 29, 2004 (DE) ..... 10 2004 015 741

(51) Int. Cl.
*F25D 13/06* (2006.01)

(52) U.S. Cl. ..... 62/304; 62/63

(58) Field of Classification Search ..... 62/304, 62/87, 401, 63, 64, 74, 91
See application file for complete search history.

(56) References Cited

U.S. PATENT DOCUMENTS 5,216,890 A * 6/1993 Ban et al. ..... 62/63
5,630,321 A * 5/1997 Miller ..... 62/63
5,893,270 A * 4/1999 Arph ..... 62/65
5,894,030 A * 4/1999 Gibson et al. ..... 426/524
6,761,043 B1 * 7/2004 Reznikov et al. ..... 62/603
2004/0099005 A1 * 5/2004 Newman et al. ..... 62/374

FOREIGN PATENT DOCUMENTS

DE 32 15 248 10/1983

(Continued)

OTHER PUBLICATIONS

Patent Abstracts of Japan, vol. 6, No. 196 (M-161), Oct. 5, 1982 & JP57 103728 A (Nippon Steel Corp), Jun. 28, 1982.

(Continued)

*Primary Examiner*—Melvin Jones
(74) *Attorney, Agent, or Firm*—Friedrich Kueffner

(57) ABSTRACT

Disclosed is a device (1) for cooling metal sheets and strips during the production thereof, particularly following rolling thereof. Said device (1) comprises a feeding duct (2) for delivering a cooling medium, especially water. Said feeding duct (2) is connected to a housing (3) inside which two nozzle rails (4, 5) are disposed so as to be movable relative to one another. Said two nozzle rails (4, 5) can be arranged at a short distance (a) from each other, thereby forming a nozzle gap (6) for the cooling medium, said nozzle gap (6) having a rectangular cross section. At least one element (8) that forms a barrier for the cooling medium is placed in the housing (3) between the point of entrance (7) of the cooling medium into the housing (3) and the nozzle gap (6).

10 Claims, 2 Drawing Sheets

FOREIGN PATENT DOCUMENTS

Figure 1:
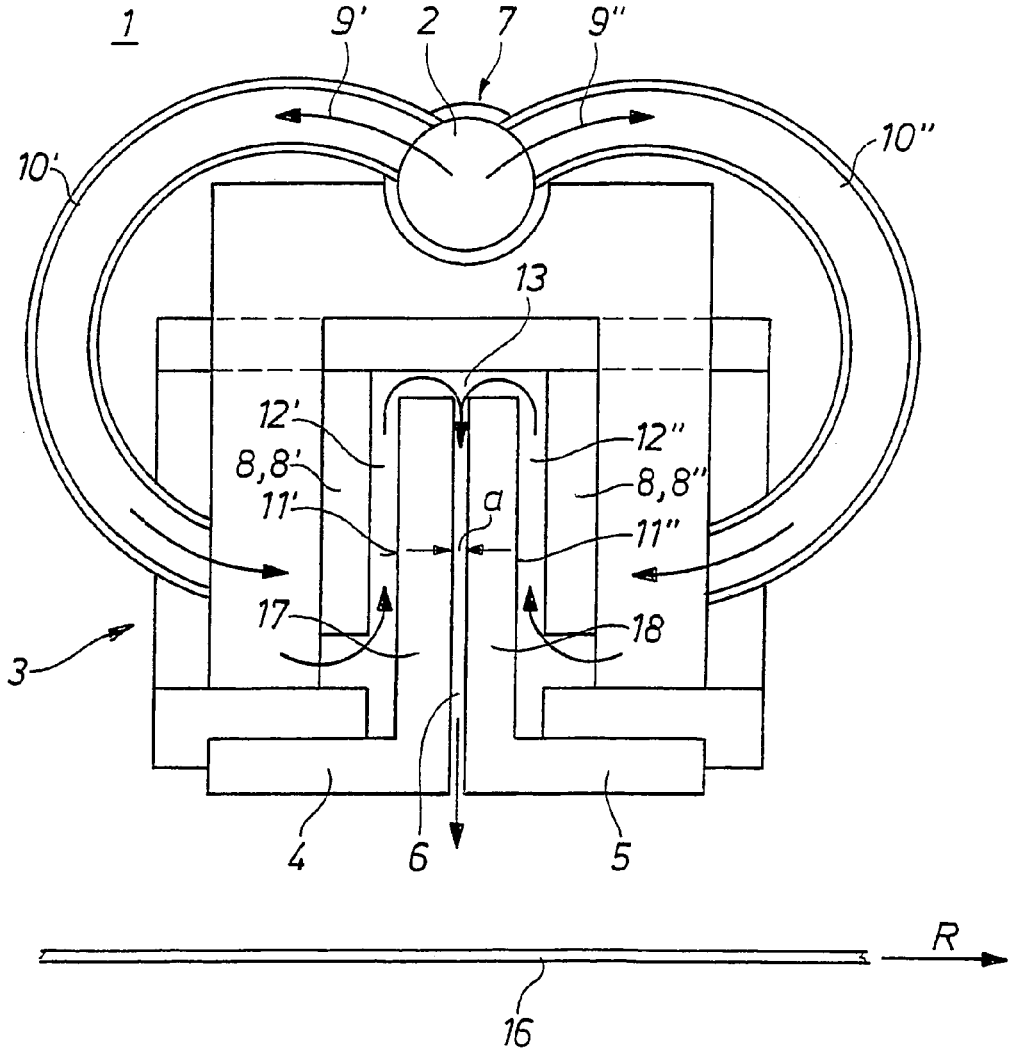

| | | |
|---|---|---|
| DE | 33 34 251 | 4/1985 |
| DE | 22 35 063 | 4/1986 |
| DE | 35 37 508 | 4/1986 |
| DE | 36 34 188 | 4/1988 |
| JP | 57103728 | 6/1982 |
| JP | 58068419 | 4/1983 |
| JP | 60133911 | 7/1985 |
| JP | 8039126 | 2/1996 |

OTHER PUBLICATIONS

Patent Abstracts of Japan, vol. 7, No. 47, (M-196), Feb. 24, 1983 & JP 57 195528 A (Ishikawajima Harima Jukogyo KK), Dec. 1, 1982.

* cited by examiner

DEVICE FOR COOLING METAL SHEETS AND STRIPS

The invention relates to a device for cooling sheets and strips during the manufacture thereof, particularly after rolling. The device includes a supply line for supplying a cooling medium, particularly water, which is connected to a housing, wherein two nozzle rails, which are movable relative to each other, are arranged in the housing. The nozzle rails can be arranged at a distance from each other so as to form a nozzle gap having a rectangular cross section for the cooling medium.

During the manufacture of sheets and strips, particularly in flat steel rolling mills, it is necessary at various locations to cool the sheet or the strip in order to influence the material properties of the rolling stock in a targeted manner and to impart to the rolling stock the desired properties. Various cooling devices are known in the art for this purpose. Spray beams having nozzles, which are arranged offset from each other, are known for cooling sheets and strips during the manufacture thereof. These spray beams make it possible to spray a defined water stream having a certain geometric shape onto the rolling stock. A quantity of water per unit of time as well as the type of water jet are decisive with respect to the desired cooling effect. Depending on the application, nozzles with full jets, flat jets or conical jets are used.

Nozzle beams having a plurality of (up to several hundred) individual nozzles are sometimes configured into a cooling system, which builds a cooling stretch in a sheet metal manufacturing plant.

It is difficult in this connection to select a suitable nozzle type and to determine a nozzle arrangement, which defines the spray pattern. When manufacturing the cooling system, it is frequently quite cumbersome to place the individual nozzles and to arrange them by means of screw elements or welding or gluing. Another disadvantage is that known nozzles of the above-described type clog easily and it is cumbersome to clean out the nozzles.

DE 36 34 188 C2 describes a cooling device for flat rolling stock in which cooling is effected by means of a water curtain with laminar flow. In order to adjust the water curtain to the width of the material to be cooled, a particularly configured slotted nozzle is provided which is composed of two L-shaped elements, which are movable relative to each other. DE 32 15 248 A1 discloses a device for producing a closed water curtain for cooling strips and sheets. In order to obtain a coherent water curtain and a large wetting width at high dropping heights, while not using adjustable or pivotable wall portions of the nozzles, it is provided, in the area of the nozzle inlet or along the portion of the dropping height of the water flow, to adjust by means of a targeted expansion of the cross-section a pressure loss and thus, a reduction of the discharge speed. Similar solutions which deal with a particularly efficient construction of spray nozzles and spray beams are disclosed in DE 33 34 251 C2, JP 60 13 39 11, JP 80 39 126 and JP 58 06 84 19.

A cooling device for sheets and strips of the above-described type is described in JP 57 10 37 28. Cooling water is supplied to the housing of the cooling device by means of a supply line. The housing contains two nozzle rails which are arranged so as to be displaceable relative to each other and which are positionable at a predetermined distance. This creates a nozzle gap having a rectangular cross-section through which the water is ejected under pressure and is conducted onto the rolling stock to be cooled. The adjustment of the spacing of the nozzle rails and, thus, the width of the nozzle gap is effected by an electric motor.

Even though a cooling device of this type already achieves good operational results, it has been found that the known construction of a cooling system still does not operate in an optimum manner because the uniform water distribution on the material to be cooled sometimes creates problems. The known system is sensitive to pressure variations in cooling medium supply, so that it cannot be ensured under all operating conditions that an optimum spray pattern and, thus, the best possible material properties during the production of sheets or strips is ensured.

Therefore, it is the object of the invention to further develop a device for cooling sheets and strips of the above-described type in such a way that the mentioned disadvantages are avoided, i.e., an absolute uniform application of the cooling medium onto the sheet or strip is ensured.

The solution of this object as a result of the invention is characterized in that, in a device for cooling sheets and strips, at least one element is arranged between the entry point of the cooling medium into the housing and the nozzle gap which element forms a barrier for the cooling medium.

The element is preferably constructed as a baffle plate, which deflects the flow of cooling medium in the interior of the housing. The element may be constructed as a plane plate, which extends parallel to the nozzle rails. The length of the element preferably corresponds essentially to the length of the nozzle rails, as seen in the direction transverse of the conveying direction of the sheet or strip.

In accordance with a preferred further development of the invention, the cooling medium is divided at the entry point into the housing into two symmetrical flows which are conducted into ducts to a nozzle rail each, wherein at least one barrier element each is arranged between the duct and the nozzle rail or in the duct. In accordance with a particularly preferred feature, the element and a side of the nozzle rail facing away from the nozzle gap form a gap having a rectangular cross-section for the cooling medium. The cooling medium is advantageously conducted from the gap to the nozzle gap, wherein both flows of the cooling medium are reunited at the entry point at the nozzle gap. Finally, it may be provided in this embodiment that the ducts have an arch-shaped, particularly circular arch-shaped cross-section.

An alternative embodiment of the invention provides that the cooling medium is divided at the entry point in two symmetrical flows which are conducted in two ducts to the nozzle gap, wherein a single element is arranged in such a way that it reduces the cross-section of both ducts. The element is preferably constructed as a plate which is arranged between two housing walls in such a way that two passage gaps with defined widths are created.

The proposal according to the invention achieves various advantages:

First, by displacing the two nozzle rails, i.e., by adjusting the distance between the nozzle rails, it is possible in a simple manner to adjust the width of the slot nozzle and, thus, to achieve a desired jet thickness. The jet is constant over the entire width of the strip or sheet. Accordingly, the thickness of the cooling jet can be easily adjusted as a consequence of the adjustability to the respective technological requirements.

Because of this construction, there is no danger that cooling strips are created, i.e., areas in the sheet or strip which are cooled to a different extent than other areas.

The proposed device is distinguished by a simple construction which can be realized in an inexpensive manner.

To be particularly emphasized is an absolutely uniform water application onto the sheet or strip to be cooled, so that a maximum homogeneity of the material structure in the plate or sheet can be achieved. The formation of cooling strips on the sheet or strip is prevented as a result.

In the event of contamination, the proposed nozzle system can be easily cleaned which results in a high availability and operational safety.

In the drawing, two embodiments of the invention are illustrated.

Figure 2:
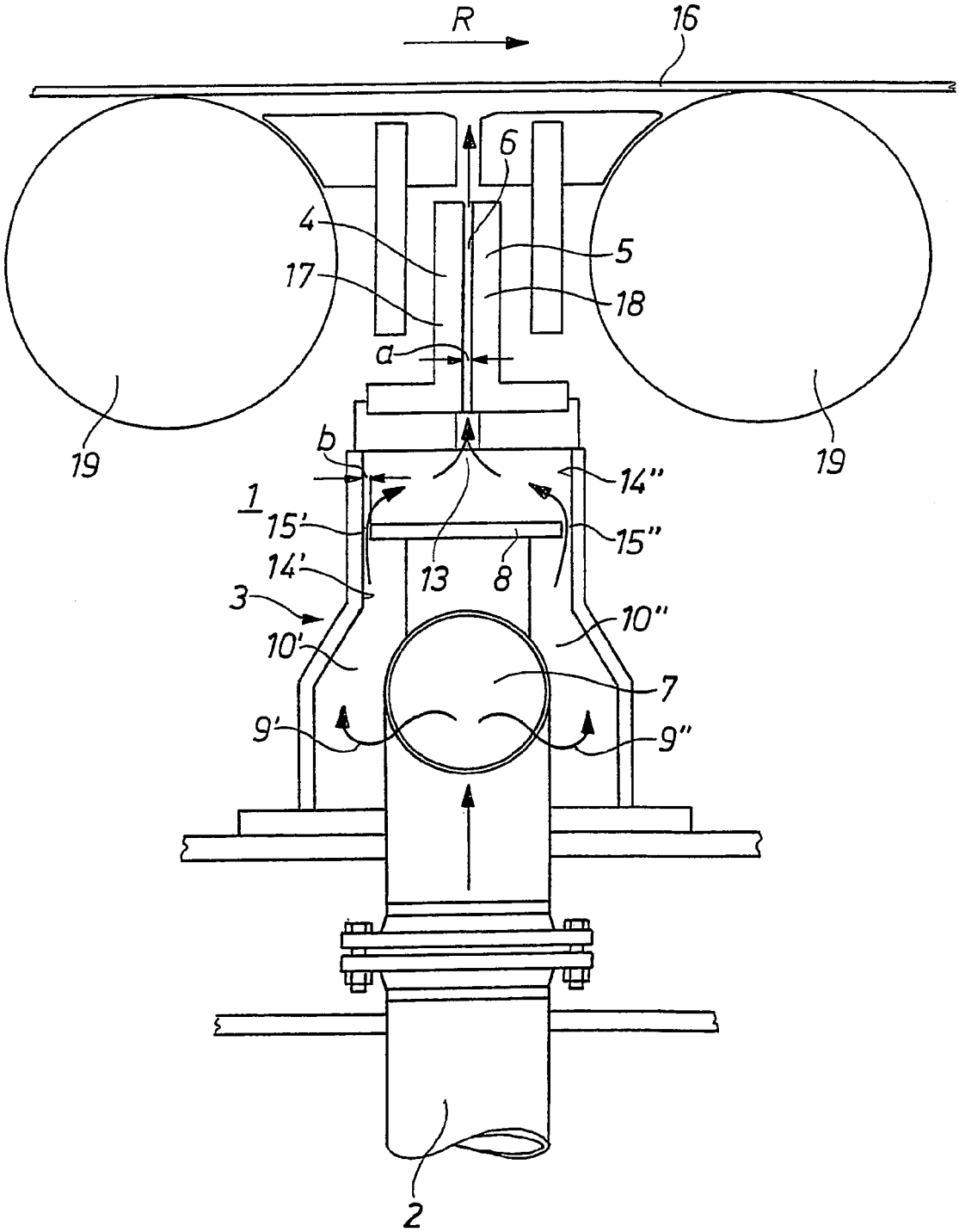

In the drawing:

FIG. 1 is the sectional view of a device for cooling a sheet or strip in a side view; and FIG. 2 shows an embodiment different from that of FIG. 1.

FIG. 1 shows a device 1 for cooling plates or strips during the manufacture thereof. A strip or sheet 16 is conveyed in the conveying direction R underneath the device 1 at a constant speed. For obtaining the desired material properties, cooling medium must be sprayed in the form of water in a defined manner onto the surface of the sheet 16; this is achieved by the device 1. It should be noted that the illustration of FIG. 1 is a sectional view of the arrangement, wherein the illustrated structure extends over a certain width perpendicularly of the drawing plane and the width of the device 1 is at least the width of the strip 16 to be cooled.

In order to be able to spray cooling medium in the form of water in a defined manner onto the surface of the sheet 16, the device 1 has a housing 3 which is connected to a supply line 2 for water. The water is conducted within the housing 3 from the entry point 7 of the water at the supply line 2 to a nozzle gap 6 which is formed by two nozzle rails 4 and 5 which are arranged at a distance a from each other. In the illustrated cross-sectional view, the two nozzle rails 4, 5 have a L-shaped contour and—not illustrated in detail—can be moved relative to each other in or against the conveying direction R in such a way that the desired clearance distance a between the two legs 17 and 18 of the nozzle rails 4, 5 is achieved. As a result, the nozzle gap is defined by means of which it is possible to spray cooling medium in the form of a water curtain onto the sheet 16.

In order to make it possible to apply water from the nozzle gap 6 in a way which is as uniform as possible and, thus, to prevent the formation of cooling strips on the sheet 16, an element 8 is arranged within the housing 3 in the area of the flow path of the water between the entry point 7 and the nozzle gap 6; this element 8 constitutes a barrier for the water. In the embodiment of FIG. 1, the element 8 is constructed as a baffle plate which has the illustrated rectangular contour and extends over the width of the device 1 perpendicularly of the drawing plane.

From the entry point 7, the water is divided into two symmetrical flows 9' and 9" which are conducted in two circular arch-shaped ducts 10' and 10" into the area of the sides 11' and 11" of the legs 17 and 18 of the nozzle rails 4 and 5, respectively. However, the baffle plate 8 is arranged at that location so as to form a barrier for the water which causes the water to be deflected as illustrated by arrows in FIG. 1. The water is conducted through a gap 12' or 12" having a rectangular cross-section which is formed between the sides 11' and 11" which face away from each other and the baffle plate 8' and 8". In the upper end region of this gap 12' or 12", the water is once again deflected and conducted to the entry point 13 of the nozzle gap 6. This is where the two flows 9' and 9" of the water are united and emerge together through the nozzle gap 6.

The cooling device illustrated in FIG. 1 is particularly suitable for conducting water onto the sheet 16 from the top. If the sheet 16 is to be cooled from below, a cooling device as it is illustrated in FIG. 2 is used preferably, but not exclusively.

Also in this case, the sheet 16 is conveyed in the conveying direction R by means of guide rollers 19; the water is supplied from below by means of the device 1.

The construction of the device shown in FIG. 2 is the same in principle as the one of FIG. 1. The water enters at the entry point 7 from the supply line 1 into the housing 3. The two nozzle rails 4, 5 are also in this case constructed L-shaped, wherein the spacing a is created between the two legs 17, 18 of the nozzle rails 4, 5 and the width of the nozzle gap 6 is defined.

At the entry point 7, the water once again branches into two symmetrical flows 9' and 9", wherein the flows are conducted through ducts 10', 10" within the housing 3 to the nozzle gap 6.

In this case, the element 8 is constructed as a single plane plate which is placed in the area of the ducts 10', 10" in such a way that passage gaps 15' and 15" are formed at two housing walls 14' and 14" which each have a width b. After passing the passage gaps 15' and 15", the two water flows 9' and 9" once again reunite at the entry point 13 into the nozzle gap 6 and flow together through the gap.

The proposed configuration provides an absolutely uniform application of the sheet 16 with cooling water and, thus, provides the possibility of precisely adjusting the technological border conditions for obtaining the desired material properties and, thus, to increase the quality of the strip or plate to be manufactured.

LIST OF REFERENCE NUMERALS

1 Device
2 Supply line
3 Housing
4 Nozzle rail
5 Nozzle rail
6 Nozzle gap
7 Entry point of the cooling medium
8 Element
8' Element
8" Element
9' Cooling medium flow
9" Cooling medium flow
10' Duct
10" Duct
11' Side of nozzle rail
11" Side of nozzle rail
12' Gap
12" Gap
13 Entry point at nozzle gap
14' Housing wall
14" Housing wall
15' Passage gap
15" Passage gap
16 Sheet, strip
17 Leg
18 Leg
19 Guide roller
a Distance
b Width
R Conveying direction

The invention claimed is:

1. Device (1) for cooling sheets and strips during the manufacture thereof, particularly after rolling, the device having a supply line (2) for supplying a cooling medium, particularly water, which is connected to a housing (3), wherein two nozzle rails (4, 5) which are moveable relative to each other are arranged in the housing (3), wherein the nozzle rails (4, 5)

can be arranged at a distance (a) from each other and form a rectangular nozzle gap (6) for the cooling medium as a result, wherein at least one element (8) which forms a barrier for the cooling medium is arranged in the housing (3) between an entry point (7) of the cooling medium into the housing (3) and the nozzle gap (6).

2. The device according to claim 1, wherein the element (B) is constructed as a baffle plate which deflects the flow of the cooling medium in the interior of the housing (3).

3. The device according to claim 1, wherein the element (8) is constructed as a plane plate extending parallel to the nozzle rails (4, 5).

4. The device according to claim 3, wherein the length of the element (8) is essentially equal to that of the nozzle rails (4, 5).

5. The device according to claim 1, wherein the cooling medium is divided at the entry point (7) into the housing (3) into two symmetrical flows (9', 9") which are conducted in two ducts (10', 10") to a nozzle rail (4, 5) each, wherein an element (8', 8") each is arranged in the ducts (10', 10") in front of the nozzle rail (4, 5) in the flow direction.

6. The device according to claim 5, wherein the element (8', 8") and a side (11', 11") facing away from the nozzle gap (6) of the nozzle rail (4,5) form a gap (12', 12") for the cooling medium which is rectangular in cross-section.

7. The device according to claim 6, wherein the cooling medium is conducted from the gap (12', 12") to the nozzle gap (6), wherein the two flows (9', 9") of the cooling medium are once again reunited at the entry point (13) at the nozzle gap (6).

8. The device according to claim 5, wherein the ducts (10', 10") have at least over sections thereof an arch-shaped, particularly circular arch-shaped configuration.

9. The device according to claim 1, wherein the cooling medium is divided at the entry point (7) into the housing (3) into two symmetrical flows (9', 9") which are conducted in two ducts (10', 10") to the nozzle gap (6), wherein a single element (8) is arranged in such a way that the element reduces the cross-section of both ducts (10', 10").

10. The device according to claim 9, wherein the element (8) is constructed as a plate which is arranged in such a way between two housing walls (14', 14") that two passage gaps (15', 15") having a defined width (b) are formed.

* * * * *